US006222145B1

(12) United States Patent
Cook et al.

(10) Patent No.: US 6,222,145 B1
(45) Date of Patent: Apr. 24, 2001

(54) MECHANICAL STRENGTH DIE SORTING

(75) Inventors: Robert F. Cook, Putnam Valley, NY (US); Eric G. Liniger, Danbury, CT (US); Ronald L. Mendelson, Richmond; Dean R. Sanders, Williston, both of VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/182,333

(22) Filed: Oct. 29, 1998

(51) Int. Cl.[7] ..... B07C 5/344

(52) U.S. Cl. ..... 209/573; 209/599; 209/938; 382/145

(58) Field of Search ..... 209/552, 559, 209/560, 561, 576, 599, 573, 587, 577, 938; 356/430, 394; 250/559.45, 559.46, 559.47, 559.48, 55.49; 348/91, 87, 126; 382/145

(56) References Cited

U.S. PATENT DOCUMENTS

| | | | | |
|---|---|---|---|---|
| 3,384,236 | | 5/1968 | Best et al. . | |
| 3,584,741 | | 6/1971 | Schirmer . | |
| 3,702,923 | | 11/1972 | Wiesler et al. . | |
| 3,720,309 | | 3/1973 | Weir . | |
| 3,847,284 | | 11/1974 | Wiesler et al. . | |
| 4,316,757 | * | 2/1982 | Walsh | 156/286 |
| 4,376,583 | * | 3/1983 | Alford et al. | 356/237 |
| 4,477,926 | | 10/1984 | Linger et al. . | |
| 4,889,242 | | 12/1989 | Willberg et al. . | |
| 4,976,356 | | 12/1990 | Mizuno et al. . | |
| 5,058,749 | | 10/1991 | Jong . | |
| 5,197,607 | | 3/1993 | Håkansson . | |
| 5,253,765 | | 10/1993 | Moorehead et al. . | |
| 5,523,696 | * | 6/1996 | Charlton et al. | 324/758 |
| 5,888,838 | * | 3/1999 | Mendelson et al. | 438/15 |

* cited by examiner

*Primary Examiner*—Donald P. Walsh
*Assistant Examiner*—Jonathan R Miller
(74) *Attorney, Agent, or Firm*—Connolly Bove Lodge & Hutz, LLP; Robert Walsh, Esq.

(57) ABSTRACT

A method for sorting integrated circuit chips. At least one physical defect is detected in the semiconductor chips. The semiconductor chips are sorted based upon the physical defect.

25 Claims, 4 Drawing Sheets

MECHANICAL STRENGTH DIE SORTING

FIELD OF THE INVENTION

The present invention relates to semiconductor chip manufacture and a method and apparatus for detecting physical strength of semiconductor chips.

BACKGROUND OF THE INVENTION

The production of semiconductor devices may be considered to include a plurality of stages. Each stage may include one or more steps from the provision of a semiconductor substrate to the final mounting of an individual semiconductor chip onto a carrier and subsequent incorporation of the carrier into a larger device. The production process may be thought of as roughly involving four stages.

In the first stage, which may be identified as front end of line (FEOL), processes are carried out on a semiconductor substrate. Such a substrate is typically silicon. However, other substrates, such as silicon carbide, or other crystalline or amorphous materials may be utilized as a substrate.

Front end of line processing may including implanting into or depositing onto the semiconductor substrate dopants and/or other materials. The semiconductor substrate may also be heat treated. Typically, FEOL processes may be thought of as generating many individual logic gates, memory cells, and/or other discrete circuit elements on and/or over the surface of the semiconductor substrate.

The second stage of semiconductor device manufacture may be referred to as "back end of line" (BEOL) processes. BEOL processes may include depositing one or more layers of one or more conductors and/or insulators onto the wafer and the structures created during the FEOL processing to form three-dimensional structures interconnecting individual elements in and/or on the semiconductor substrate. BEOL processes typically may be thought of as creating very large scale integrated (VLSI) circuits patterned in an array over the semiconductor substrate as individual devices. Typically, the array of VLSI circuits is rectangular.

After BEOL processing, VLSI devices typically are probed and/or tested for speed and/or quality. A map of the electrical performance of devices and/or circuits on the wafer may also be generated as part of BEOL processing.

Typically, a plurality of chips are created on one semiconductor substrate. After BEOL processing, the semiconductor substrate typically is subjected to processes under the general heading of dice, sort, and pick (DSP). DSP processes typically involve separating individual devices, commonly referred to as "dice" (plural of "die") or chips, from each other. The individual devices typically are separated by somehow cutting or sawing the semiconductor substrate. The semiconductor substrate may be provided with intervening scribe lines between the individual devices.

During dicing, the overall semiconductor substrate may be supported by a support structure. The support structure may include an adhesive or other means to immobilize the individual chips during and/or after separation from the other chips and/or other portions of the semiconductor substrate. After cutting or otherwise separating the individual devices, each individual device may be picked up from the support structure. The picking of the devices may be controlled according to a performance map generated during the BEOL processing stage.

After cutting or otherwise separating the individual devices from the overall semiconductor substrate, the individual devices may be placed in containers suitable for packaging operations.

The production of semiconductor devices may also include a fifth stage that typically takes place after BEOL processing. According to the fifth stage, the semiconductor substrate and/or individual chips may undergo a back-side grind (BSG) operation. During BSG processing, semiconductor wafers may be ground on the back or non-device side.

The grinding may be carried out utilizing any suitable physical grinding means. For example, a grinding wheel may be used to grind the back-side of the semiconductor wafer to result in a wafer of a desired thickness. The back-side surface finish of the semiconductor wafer may also be controlled during the BSG processes. However, it is not necessary that the semiconductor wafer or chips be subjected to BSG processing.

After the DSP stage of processing, the individual separated semiconductor chips may be subjected to packaging (PKG) operations. Typically, PKG processing involves mounting an individual chip onto a larger carrier. Electrical connections may then be made between the chip and the electrical circuitry of the carrier. Then, the chip and carrier may be sealed or encapsulated in a suitable material or housing. After sealing, the chip and chip carrier may be electrically or mechanically tested.

SUMMARY OF THE INVENTION

Aspects of the present invention provide a method for sorting integrated circuit chips after separation from other chips. The method includes detecting at least one physical defect in the semiconductor chips and sorting the semiconductor chips into more than one acceptable classification based upon the physical defect.

The present invention also provides a device for sorting integrated circuit chips. The device includes a detector for detecting at least one physical defect in the semiconductor chips. A sorter sorts the semiconductor chips into more than one acceptable classification based upon the physical defect.

Further aspects of the present invention provide a method for forming an electronic package including a semiconductor chip and a semiconductor chip carrier. The method includes creating a plurality of semiconductor chips on a substrate. The individual semiconductor chips are separated from each other and/or from other portions of the substrate. At least one physical defect is detected in the semiconductor chips. The separated semiconductor chips are sorted based upon the physical defect. The semiconductor chips are mounted onto a carrier.

Still other objects and advantages of the present invention will become readily apparent by those skilled in the art from the following detailed description, wherein it is shown and described only the preferred embodiments of the invention, simply by way of illustration of the best mode contemplated of carrying out the invention. As will be realized, the invention is capable of other and different embodiments, and its several details are capable of modifications in various obvious respects, without departing from the invention. Accordingly, the drawings and description are to be regarded as illustrative in nature and not as restrictive.

BRIEF DESCRIPTION OF THE DRAWINGS

The above-mentioned aspects of the present invention will be more clearly understood when considered in conjunction with the accompanying drawings, in which.

DETAILED DESCRIPTION OF THE INVENTION

Figure 1:
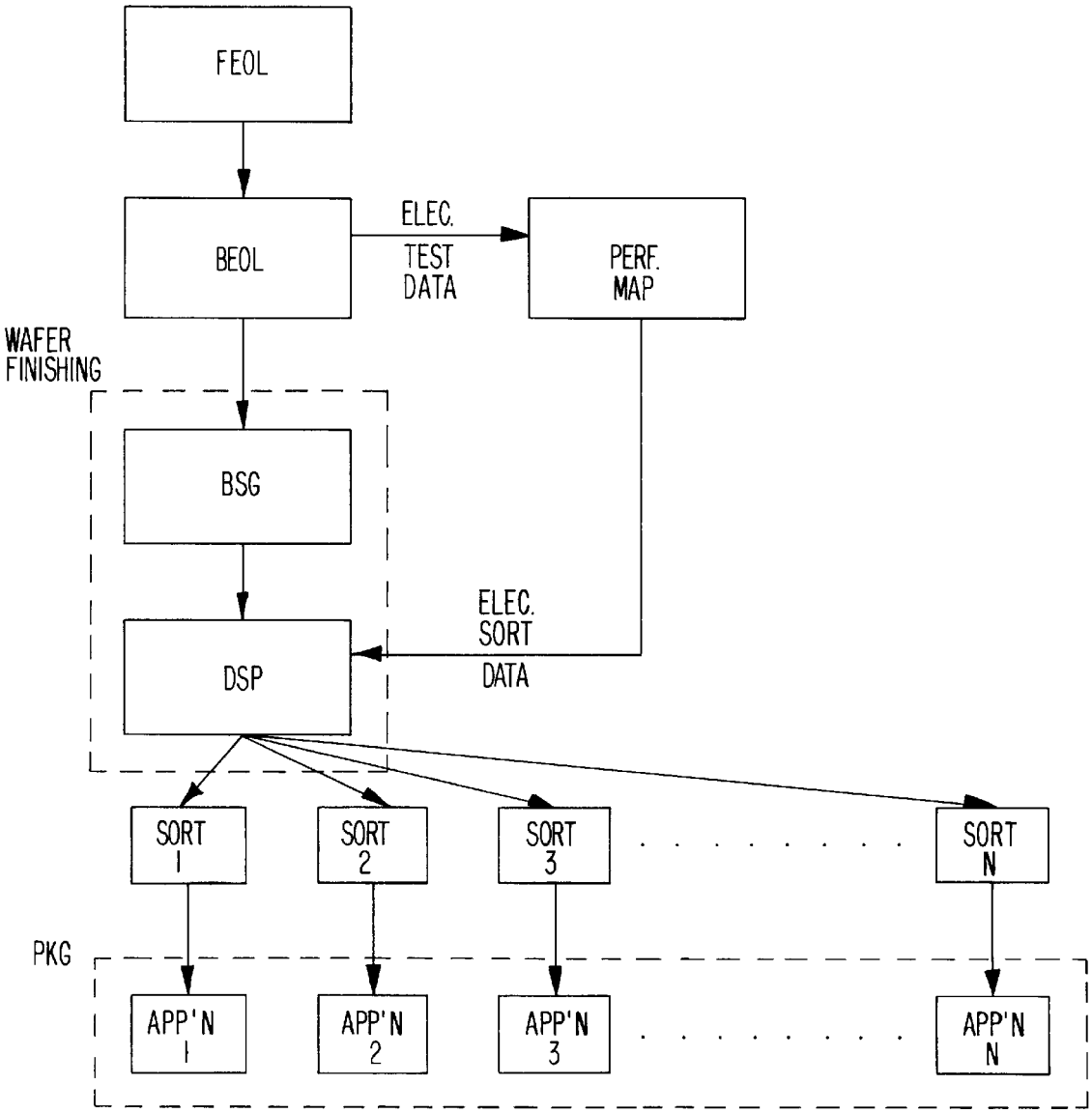
FIG. 1 represents a flowchart illustrating various stages in the process of manufacturing semiconductor devices and assembling them into electronic components.

During production and processing of semiconductor devices, such as semiconductor chips, proper electrical and mechanical functioning of the semiconductor devices is very important. For example, improper FEOL or BEOL processing or electrical mis-sorting during DSP may lead to devices that fail to perform with the appropriate electrical characteristics. Similarly, improper processing during the DSP and PKG stages or mechanical mis-sorting or non-sorting may lead to devices that fail mechanically.

Along these lines, many packages into which semiconductor devices are incorporated or are joined to may impose significant mechanical stresses on the semiconductor device, typically referred to as a chip or die. An example of such stresses are tensile stresses. Often times, tensile stresses may be the most damaging to semiconductor devices. Regardless of the type of mechanical stress, such stress may lead to fracture of often brittle semiconducting materials.

The strength of semiconductor devices often is critical to achieving an acceptable mechanical yield during and after the PKG stage of processing. Similar to the importance of proper processing during FEOL and BEOL stages to acceptable electrical yield and performance prior to wafer finishing, appropriate mechanical processing may be important during the PKG stage of processing to result in an acceptable mechanical yield.

The present invention is directed toward a method and device for detecting indicators of mechanical strength of semiconductor devices, such as semiconductor chips, and sorting the semiconductor devices according to mechanical strength as estimated from the detected physical parameter. Sorting will take into account different relative stress levels that various packages, such as chip supports, will apply to the semiconductor devices attached to or incorporated into the supports. Chips having a greater estimated or calculated strength may be directed to packages that exert greater mechanical stress on the semiconductor devices. On the other hand, semiconductor devices having less detected, calculated or estimated mechanical strength may be directed to supports that are determined to exert less mechanical stress on the attached semiconductor devices.

The present invention follows the reasoning that greater strength semiconductor devices will be more resistant to fracture. For example, metallic lead frames may impose greater stress on a chip or die than a fiberglass-polymer composite laminate, which, in turn, may impose greater stress on a chip or die than a ceramic chip support or substrate.

Typically, currently used processes for testing semiconductor devices test the devices to verify electrical performance and function. These processes lack any testing or sorting based upon mechanical strength. It follows that typical processes do not match the strength of a die or chip to stresses that the chip or die will encounter during PKG processing and stresses that the chip or die will encounter as part of an electronic package attached to a chip support.

A lack of detection and analysis of mechanical strength and sorting based upon mechanical strength of semiconductor chips increases the probability that a relatively low strength semiconductor chip will be attached to a relatively high stress substrate, leading to increased yield loss in PKG schemes. Losses due to mechanical failure of semiconductor chips could be reduced to a minimum, or at least the probability of mechanical failure of the semiconductor chip may be reduced to a minimum, by sorting the semiconductor chips into various groups based upon a detected and analyzed mechanical strength of the chips. The groups may include a plurality of acceptable defect levels. Chips with various defect levels may be directed to different applications with various stress levels.

By directing the semiconductor devices to packages with appropriate stress levels, the present invention can lead to smaller yield losses and greater reliability of the package that includes the semiconductor device and support. As a result, the present invention can help produce smaller yield losses and greater reliability of both the processes for producing semiconductor device packages and greater reliability of the resulting packages.

Accordingly, the present invention solves problems associated with misdirecting of low strength chips into high stress packages by providing a method and apparatus for sorting semiconductor chips based upon mechanical strength characteristics. In particular, the present invention is directed to a method and apparatus for detecting at least one physical parameter indicative of physical strength of a semiconductor chip, analyzing the detected information, and sorting the semiconductor chips based upon the analysis of the detected information. Accordingly, the present invention provides a method and apparatus for classifying chips according to mechanical strength, such as tensile and/or bending strength, by direct inspection of at least one physical characteristic of the semiconductor chips. The method and apparatus of the present invention may be inserted into standard picking and/or packaging operations without requiring additional, potentially strength degrading, contact with the semiconductor chip.

FIG. 1 schematically illustrates the various stages at typical semiconductor device manufacturing processes include, as described above. As stated above, typically, known semiconductor device manufacturing processes only test electrical functioning of semiconductor devices. As illustrated in FIG. 1, during DSP processing, the semiconductor devices may be sorted based upon the results of the electrical testing.

However, just as the processes utilized in forming semiconductor chips do not always result in perfectly formed and electrically functioning chips, the processes may also result in semiconductor chips that are not optimally physically functional. For example, as stated above, typically, a plurality of semiconductor chips are formed on a single semiconductor substrate. The individual chips are then separated.

Figure 2:
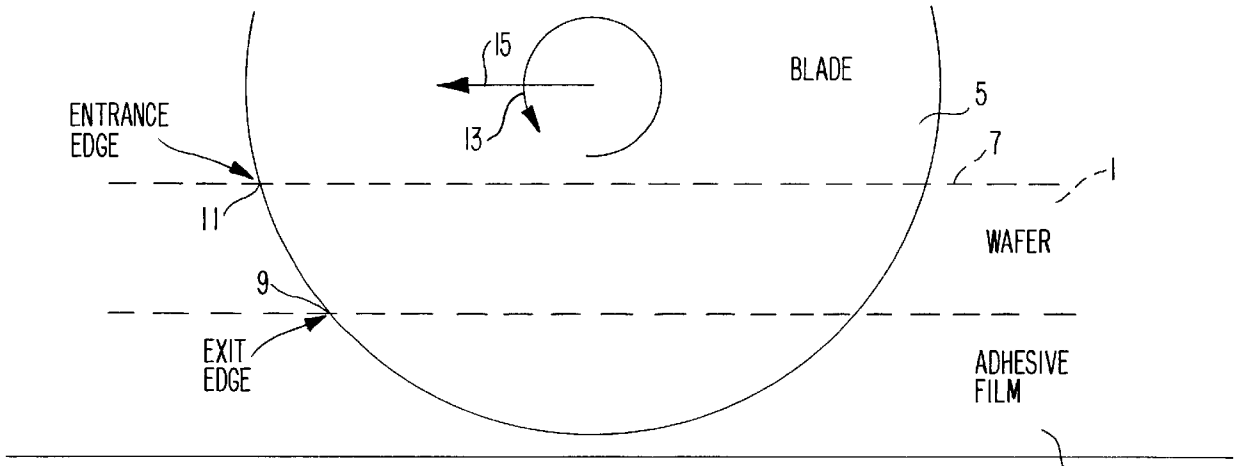
FIG. 2 represents a cross-sectional view of a semiconductor wafer substrate in the process of being separated into individual semiconductor chips by a rotating blade.

FIG. 2 illustrates a schematic cross-sectional view of one method for separating, or dicing, a semiconductor wafer into individual chips. In the method illustrated in FIG. 2, a rotating blade is moved through the semiconductor wafer, much as a saw cuts a board into smaller pieces. The directions of blade rotation and blade lateral movement through the semiconductor wafer are indicated by arrows 13 and 15, respectively.

Typically, during wafer dicing, wafer 1 may be immobilized by some means. For example, the wafer shown in FIG. 2 is attached to an adhesive film 3. One example of an adhesive film 3 that may be utilized to help immobilize the semiconductor wafer and dice chips is an adhesive polymeric film. The adhesive film helps to prevent movement of the semiconductor substrate and diced chips before, during, and/or after the dicing operation. Of course, any adhesive film or material or other means may be utilized to immobilize the semiconductor chips before, during, and/or after dicing.

As the blade enters the semiconductor wafer 1 and moves through the wafer, the first point of entry of the blade is the entrance edge 11. The blade exits the wafer and finishes cutting at exit edge 9. Typically, the entrance edge is located on the active, front face of the wafer, where the devices and circuitry are located. It follows that the blade typically exits the inactive, back face of the semiconductor wafer mounted on the adhesive film.

Figure 3:
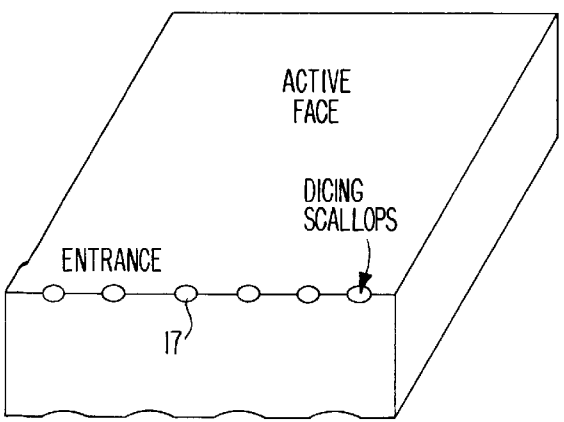
FIG. 3 represents a perspective view of an example of a front or active face of a semiconductor chip, the face that includes formed devices and circuitry, after separation from an adjacent semiconductor chip or other portion of a semiconductor wafer.

Due to the physical interaction between the blade and the semiconductor wafer, small portions of the semiconductor wafer may be removed during the dicing operation. FIG. 3 illustrates a perspective view of the active face of the diced edge of a semiconductor chip. As shown in FIG. 3, removal of material from the edges of the semiconductor chip where the blade meets the semiconductor wafer produces small scallops 17 in the edge where the blade enters the semiconductor wafer.

Although the size of the scallops may vary, typically, the scallops in the entrance edge of the semiconductor chips are less than about $1\mu$ deep into the semiconductor wafer surface and about 2 to about $3\mu$ wide, extending into the active face of the semiconductor chip. Typically, the scallops formed in the entrance edge are small and substantially uniform in size.

The dicing operation also tends to result in the removal of material from the back or inactive face of the semiconductor chip as the blade exits the semiconductor wafer at exit edge 9. Typically, the material removed from the back face of the semiconductor chips is in the form of dicing scallops 19 similar to scallops 17 removed from the active face of the semiconductor chip by the dicing operation. However, unlike the scallops in the active face, typically, the scallops from the back face are large and variable in size.

Figure 4:
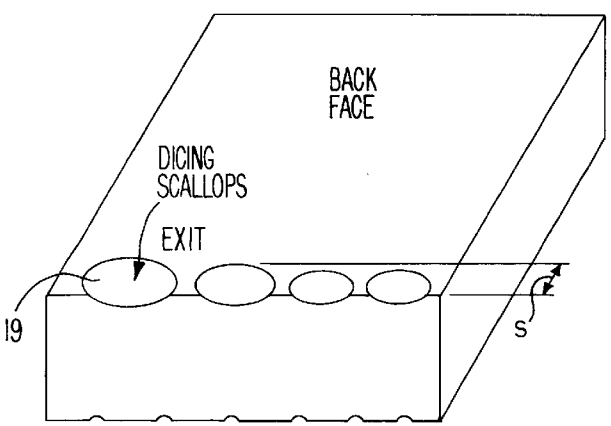
FIG. 4 represents one example of a back or inactive face of the semiconductor chip illustrated in FIG. 3 after separation from an adjacent semiconductor chip or other portion of a semiconductor wafer.

Typically, the scallops may extend from about 5 to about $10\mu$ into the thickness of the semiconductor chip. Additionally, scallops in the back face may extend anywhere from about 10 to about $100\mu$ over the back face of the chip, as illustrated in FIG. 4.

For large scallops, crack length c may vary with thickness of the substrate. Additionally, scallop size s may vary with the square root of thickness of the semiconductor chip. The strength of the semiconductor chip may vary with the square root of crack length and with the square root of thickness of the semiconductor chip. The strength of the semiconductor chip may vary as scallop size for large scallops.

For small size scallops, crack length does not vary with thickness of the semiconductor chip. Additionally, semiconductor chip strength does not vary with scallop size.

The dicing operation may also result in the formation of small, nearly invisible cracks that penetrate a chip along the edges in addition to the scallops that may be taken out of both the active face and the back face of the chips. Both the scallops and the cracks may be generated by sharp contacts arising from the impact of small, loose pieces of semiconductor material or dicing media particles driven at high speed by rotation of the dicing wheel. Such particles are somewhat analogous to "sawdust". The particles may also damage the semiconductor chips through the impact of bound dicing media particles moving at lower speeds associated with lateral "chatter", or blade wobble, of the dicing wheel within the kerf, or dicing channel. The picking operation, in which semiconductor chips are removed from the adhesive film or other immobilizing means, may also generate cracks and scallops in the semiconductor chips through contacts between chips being picked and adjacent chips remaining on the adhesive film or other immobilizing means.

Other physical processes may effect the physical strength of semiconductor chips. For example, the back face of the chips may be ground to remove material from the back face as well as to control the thickness of the chips. Such grinding may influence the strength of the chips in the form of striations in the back face resulting from the grinding process.

If physical characteristics of the semiconductor chip material are assumed to be uniform from chip to chip, then mechanical strength of individual full thickness chips may be considered to be controlled by the size of the cracks and scallops resulting from facing and/or picking operations. With respect to cracks formed during dicing and picking operations, semiconductor chips having larger cracks may be weaker than devices having smaller cracks. Typically, the strength-controlling cracks are on the back face of the semiconductor chips. Inspection of the chips during the dicing process or while the chips are stored in a chip bank while awaiting further processing may be impossible due to the small size of the cracks as well as the concealment of the back side of the chips. Alternatively, detection of the cracks may lead to unacceptable handling damage on the active face, even if the cracks could be identified.

Physical defects in semiconductor chips, whether in the form of cracks or scallops, may weaken the semiconductor chips. Weakening of the semiconductor chips may lead to failure of the semiconductor chips. Failure of semiconductor chips may result from stress placed on the semiconductor chips by packages into which the chips are incorporated.

For example, as stated above, after dicing and picking, semiconductor chips typically are attached to a substrate, such as a chip support, chip carrier, or lead frame. Often, packaging processes and subsequent use of the package can apply significant tension to the back face of a semiconductor chip. The tension may be especially significant along the long axis of the chip.

The tension generated by the package may exceed the fracture strength of the semiconductor chip. In such cases, the chip may fracture. Mechanical failure of the chips may lead to electrical failure of the chips in the overall device. The present invention is based, at least in part, upon a discovered relationship between physical defects in the chip and mechanical strength of the chip. For example, the relationship between scallop size and chip strength.

The present invention provides a method of inspecting semiconductor chips, detecting scallops in surfaces of the semiconductor chip. The present invention may help to prevent unwanted failures of chips and packages incorporating chips. The present invention may apply to any type of chips, whether square, rectangular, or other configuration, as well as other packages and stress configurations.

As illustrated in FIG. 4, scallops in the face of semiconductor chips have a width s measured perpendicular to the edge of the chip. The chip width s is measured as shown in FIG. 4.

Figure 5:
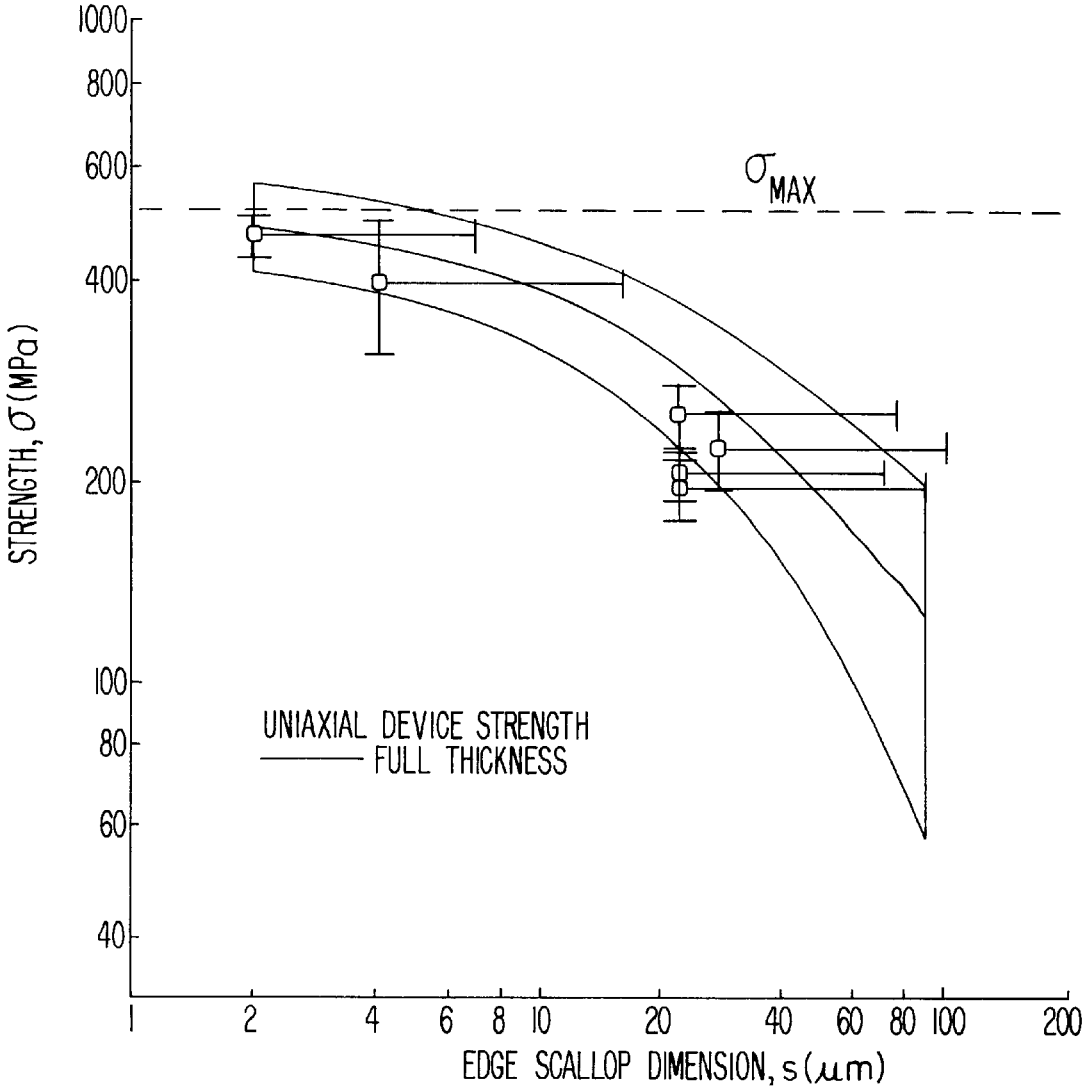
FIG. 5 represents a graph illustrating a relationship between strength of semiconductor chips and dimensions of edge scallops in the semiconductor chips.

FIG. 5 illustrates a graph showing a relationship between strength $\sigma$ of the chip and scallop size s. The chip strength $\sigma$ is considered here to be the maximum sustainable applied tensile stress that the chip may sustain without breaking. The solid line in FIG. 5 indicates the variation when s is considered the average scallop size. On the other hand, the dashed line in FIG. 5 indicates the variation when s is considered as the minimum scallop size. The relationship between scallop size and chip strength is derived from the discovered strong non-linear relationship between the scale of scallop features and lengths of cracks generated by blade particles during dicing and contacts during picking.

Subsequent to inspecting the semiconductor chips and detecting the size of the scallop or other physical defect in the semiconductor chips, the detected information may be processed and analyzed to estimate chip strength. A variety of methods may be used to analyze the physical defect data. One relationship that has been found to describe many observations of physical defects in semiconductor chips represented by scallop size and semiconductor chip strength is as follows:

$$\sigma=\sigma_{max}s^*/(s+s^*) \quad 1$$

wherein $\sigma$ is a measured strength of semiconductor chips having a scallop of size s, $\sigma_{max}$ is a maximum strength of the semiconductor chips, and s* characterizes the scallop size-scale over which the semiconductor strength varies.

According to equation 1, s may represent either average scallop size along a chip edge or a maximum observed scallop size along a chip edge. For very small scallops, such that s is much less than s*, the strength tends to an invariant maximum, $\sigma\rightarrow\sigma_{max}$. s* provides an approximate division between two strength regions. In the first region, where s is much smaller than s*, the length of cracks typically does not vary with the scallop size s and, therefore, $\sigma$ does not vary with s. Typically, the scallops themselves are not the major factor effecting the strength of the chips, but, rather, the cracks associated with the semiconductor chips. Typically, the size of the scallops is indicative of the size of the cracks.

In the second strength region, for very large scallops, such that s is much greater than s*, the strength of the semiconductor chips asymptotically approaches a limit defined by the inverse variation of scallop size, $\sigma\rightarrow\sigma_{max}(s^*/s)$. In this second strength region, the length of cracks typically varies quadratically with the scallop size.

In a third region, where s equals, or approximately equals, s*, the strength in the semiconductor chips is typically half the maximum value, such that $\sigma=\sigma_{max}/2$.

It has been found that s typically is approximately 20$\mu$ for s taken as the average scallop size. Alternatively, s* typically is approximately 100$\mu$ for s taken as the maximum scallop size. Furthermore, it has also been found that $\sigma_{max}$ is approximately 500 MPa.

Scallop size and distribution, as well as crack formation, may be varied by varying parameters relevant to the dicing and picking operation. For example, blade width, angle, orientation, rotation rate, and translation rate may all effect scallop and crack size. Additionally, depth of cut, number of blade passes, tape adhesion, and tape stiffness may also effect scallop and crack size. Furthermore, the picking protocol used, including the tape adhesion, tape stiffness, picker alignment, picker contacts on active and inactive faces may effect scallop and crack size. Still further, chip dimensions, such as thickness, area, and aspect ratio, may effect scallop and crack size and distribution.

It should be noted that equation 1 above is only one of many equations that could be utilized to estimate chip strength. However, at large flaw sizes, equation 1 does retain the fracture mechanics-based idea of an inverse square-root dependence of strength on crack length.

Additionally, measuring scallop size as shown in FIG. 4 is only one of many measurements of scallop size that may be utilized to estimate chip strength. For example, parameters characterizing scallop edge distribution, scallop diameter parallel to the chip edge, and/or scallop area could also be utilized.

The present invention includes a method for inspecting, analyzing, and sorting semiconductor chips based upon the above-described relationship that has been discovered between a physical defect in the semiconductor chips, such as a size of scallops in a semiconductor chip, and mechanical strength of a semiconductor chip. According to the method, at least one physical defect is detected in the semiconductor chips without physically stressing them, which may cause them to fail. The chips are then sorted based upon the physical defect.

Among the physical defects, which can act as a visual indicator of physical strength of semiconductor chips is scallops in the edges of semiconductor chips. At least one dimension of the scallops may be detected. The dimensions of the scallop that may be utilized to analyze chip strength include a distance that the chip extends across the back face of a chip, the cross-sectional area of the chip, the depth of the chip, the width of the chip, among other dimensions.

The physical defects, such as scallops, may be detected in the functional or non-functional side of the chips. However, defects in the non-functional or back side of the chips may be easier to detect and more indicative of physical strength of the chips. According to the method, the physical defects and their dimensions are detected visually.

In a larger view, the present invention may include separating individual semiconductor chips from other semiconductor chips and/or other portions of a substrate in and on which the semiconductor chips have been formed. The device may include a rotating blade. Alternatively, the separating device could include a scribe and break apparatus or a laser scribe.

Prior to, during, or subsequent to, separating the semiconductor chips, the chips may be engaged by at least one device for engaging, retaining, and picking up the semiconductor chips. An example of a pick up device is a vacuum pencil. The vacuum pencil may include vacuum source that retains the chip on the pick up device so that the device may pick up the semiconductor chip and remove it from an adhesive that has been retaining it, transport the semiconductor chip to a location where physical defects are detected in the semiconductor chip, then transport the semiconductor chip to an appropriate location corresponding to the analyzed physical strength.

The physical defects may be viewed by an operator or by an automated system, such as a machine vision tool. The detector detects at least one physical defect in the semiconductor chips. To detect the physical defects without physically stressing the chips the defects may be detected visually. Accordingly, the detector of the device of the present invention may includes a detector for visually sensing the semiconductor chips. One example of a detector is a machine vision tool. One example of a detector is the KIS System available from Inspectec, Inc.

A device according to the present invention may also include a processor for analyzing the detected physical defect of the semiconductor chips. The processor may analyze the detected physical defect as described above. For example, the physical defect could be a scallop in an edge of the back face of a semiconductor chip. Analysis of such a scallop is described above.

After analyzing the physical defect data, an acceptable application for the semiconductor chips may be determined. The acceptable application analysis may include factors of the type of package that the semiconductor chips are to be incorporated into and the use of the package. As stated above, different packages and uses can cause different levels of physical stress on semiconductor chips.

After analysis of the detected physical defects and estimation of chip strength, the chips may be placed into a bin corresponding to the physical strength of the chips and the corresponding package into which the chips are to be incorporated. The analysis of the physical defect data may take place as discussed above. For example, the physical strength of the chip may be estimated utilizing detected scallop size and equation 1, above.

The semiconductor chips may be directed to an application where the corresponding level of physical stress on the semiconductor chips so that it is less likely that the semiconductor chips will mechanically fail in the package. Accordingly, semiconductor chips having a higher detected physical strength typically are directed to applications or packages with higher physical stress levels and semiconductor chips having lower detected physical strength are directed to applications where the chips will experience lower physical stress levels.

The semiconductor chips may also be tested for electrical functioning and the electrical test data factored into the sorting along with the physical strength detection and analysis.

After sorting into the appropriate bin, the semiconductor chips may be attached to a support and incorporated into an electronic package. Therefore, the present invention may also include apparatus for picking up the semiconductor chips from locations into which they have been sorted to a location where they can be attached to a lead frame, chip support, or other structure to incorporate the chips into an electronic package. Accordingly, the present invention may also include apparatus for attaching semiconductor chips to a lead frame, chip support, or other structure, as well as apparatus for encapsulating the semiconductor chip and lead frame for carrying other processes to complete the electronic package.

One advantage of the present invention is that physical defects in the chip may be examined for physical defects without requiring more handling than would be necessary in handling chips during the dicing procedure and moving the diced chips into receptacles such as a tray for further processing. Since such a system is typically already used, both the method and apparatus of the present invention may be incorporated into existing apparatus. Therefore, the present invention does not require a completely new apparatus to accomplish the dicing and sorting operation. Rather, a detector may be included in the invention as well as a processor for processing the sensed data regarding the physical defects in the semiconductor chips.

Figure 6:
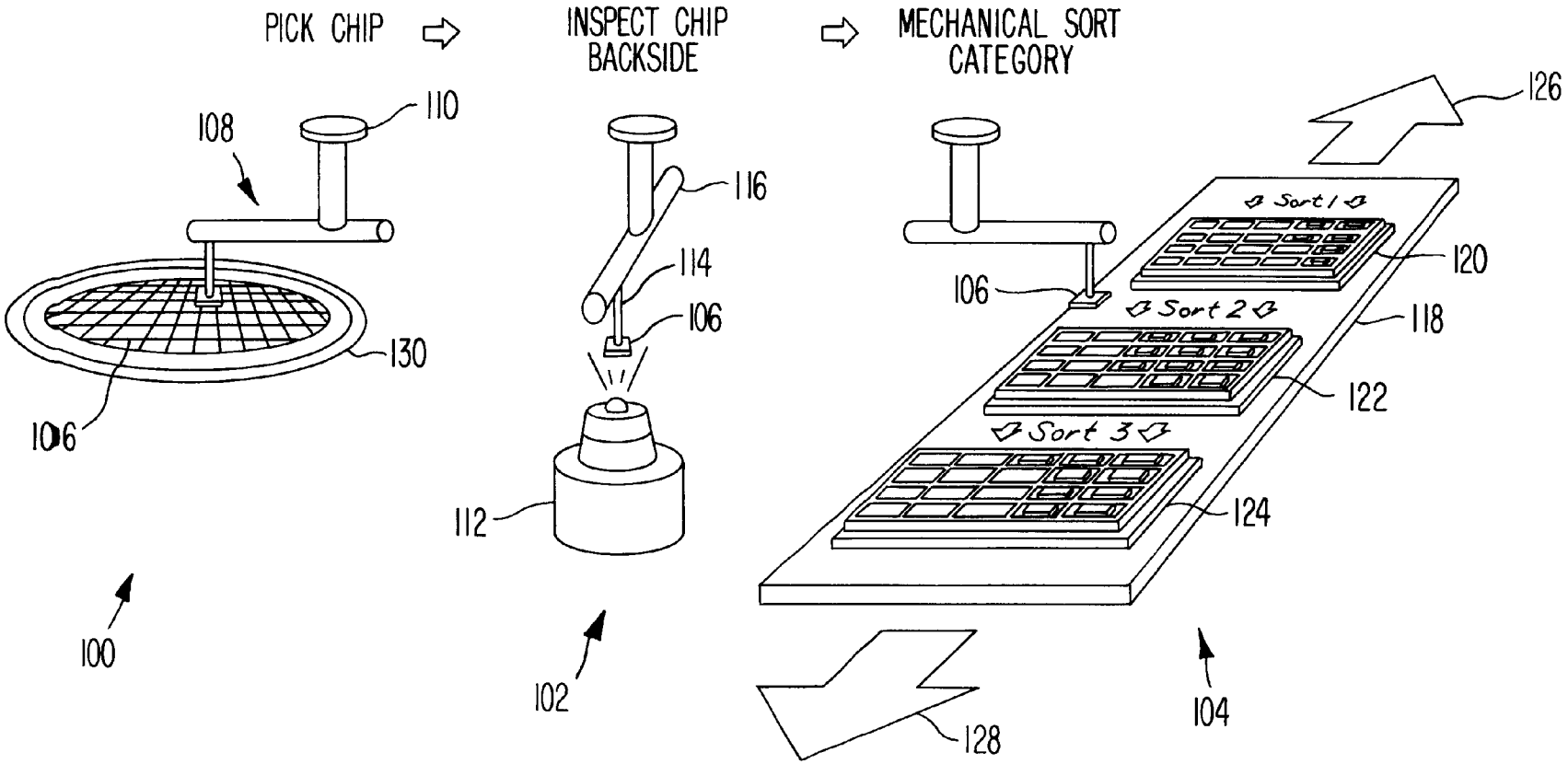
FIG. 6 represents an embodiment of a system according to the present invention for picking up semiconductor chips from the arrangement in which they have been cut, inspecting a surface of the semiconductor chips and sorting them into a plurality of locations based upon physical defects detected during the inspection.

FIG. 6 illustrates an embodiment of portions of an apparatus according to the present invention. The apparatus shown in FIG. 6 includes three stations where different functions may take place. At a first station 100, the semiconductor chips 106 may be picked up by an apparatus 108 for picking up and moving the chips. The dicing operation may take place at station 100. Alternatively, the semiconductor wafer may be diced at another location and moved to station 100.

After picking up chips, apparatus 108 may simply rotate, as indicated by arrow 110, so as to arrange the chips 106 over detector 112. Arranging the chips over detector 112 may require lateral movement of apparatus 108, as indicated in FIG. 6. Alternatively, detector 112 may be arranged so that only rotational movement is required.

After a required time has passed for detector 112 to inspect the chips and analysis of the data from the inspection has been carried out, the chips may be transported by apparatus 108 to a corresponding location based upon the mechanical sort data. The chips may be moved to the appropriate mechanical sort location by rotating apparatus 108 as well as translational movement of the apparatus, as indicated in FIG. 6.

Arm 114 supporting chips 106 may include a pick up device, such as a vacuum pencil, to retain chips 106. To facilitate pick up, inspection, and sorting of the chips, arm 114 may be movable along arm 116. Additionally, to facilitate sorting of the chips, support 118 may be movable, as indicated by arrows 126 and 128, to align the proper tray 120, 122, or 124 under arm 114 to permit a semiconductor chip to be arranged in the appropriate location based upon mechanical sort data.

According to an alternative method, chips may be inspected while at location 100. According to such an embodiment, the chips preferably are supported by a support that permits viewing of the chips from the underside of support 130. Accordingly, the adhesive film utilized to retain the chips, preferably has a sufficient degree of transparency to permit the chips to be inspected. The same may true of the optical characteristics of support 130. Such an embodiment may also include one or more light sources to illuminate the underside of the chips to permit them to be inspected. Alternatively, available light may be utilized.

Regardless of where the chips are inspected, the detector may inspect the chips utilizing visible light, infrared light, or any other portion of the spectrum.

Viewing the chips while they are still at station 100 may provide less resolution as compared to viewing the chips at station 102, since, at station 100, detection will be taking place through support 130 and/or adhesive film utilized to retain and immobilize the chips. However, detecting physical defects at station 100 may increase the speed of the picking and sorting process by permitting the chips to be inspected prior to picking.

The mechanical sort of semiconductor chips can be used to designate appropriate packaging based upon mechanical performance similar to similar processes for electrical sorting. For example, simple binary acceptance or rejection of the chips can be carried out on the basis of detected physical defects, via a predetermined strength relation and the knowledge of single package stress, in other words, the stress that the chip would experience in various packages. Alternatively, the ranges of physical defect data can be used to sort chips into multiple categories via the strength relationship and knowledge of different package stresses. For example, in a binary method, chips can be selected for a given packaging scheme with high probability of survival, minimizing or eliminating the requirement for thermal or mechanical stressing procedures that destructively select out weak devices. At the same time, attendant costs of testing and packaging devices to be destroyed may be minimized or eliminated. Regardless of the sorting method utilized, the present invention may minimize the probability of failure of weak in high stress packages and wasting of strong chips in low stress packages.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

We claim:

1. A method for sorting semiconductor chips, the method comprising the steps of:

detecting at least one physical defect in the semiconductor chips;

estimating the mechanical strength of the semiconductor chips by analyzing the at least one physical defect; and sorting the semiconductor chips into more than one acceptable classification based upon the at least one physical defect and estimated mechanical strength, wherein the physical defect is at least one dimension of a scallop in an edge of the semiconductor chip.

2. The method according to claim 1, wherein the semiconductor chips are sorted based upon an absolute dimension of the scallop estimated to the mechanical strength of the semiconductor chips.

3. The method according to claim 1, wherein detecting the at least one physical defect comprises measuring the magnitude of at least one dimension of the scallop relative to at least one dimension of the semiconductor chip that contains the scallop.

4. The method according to claim 1, wherein the at least one defect is a scallop on a non-functional side of the semiconductor chips.

5. The method according to claim 1, wherein at least one dimension of the scallops is detected visually.

6. The method according to claim 1, further comprising the step of:

separating the semiconductor chips from other semiconductor chips and/or from portions of a larger substrate on which the semiconductor chips have been formed, wherein the scallops are caused by the separating.

7. The method according to claim 6, further comprising the step of:

engaging and picking up the semiconductor chips with a device for engaging and picking up the semiconductor chips; and transporting the semiconductor chips to a location where they can be sensed by a sensor for detecting the physical defect.

8. The method according claim 7, wherein the semiconductor chip sensor is a machine vision tool.

9. The method according to claim 7, wherein the device for engaging and picking up the semiconductor chips is a vacuum pencil.

10. The method according to claim 6, further comprising the step of:

engaging and picking up the semiconductor chips with a device for engaging and picking up the semiconductor chips, wherein the physical defect is detected prior to engaging and picking up the semiconductor chips.

11. The method according to claim 1, wherein the at least one physical defect and estimated mechanical strength are used to determine an acceptable application for the semiconductor chips.

12. The method according to claim 11, wherein the acceptable application includes at least one member selected from the group consisting of a package type that the semiconductor chips are to be incorporated into and a use of the package.

13. The method according to claim 1, wherein the semiconductor chips are sorted according to the following relationship:

$$\sigma=\sigma_{max}s^{*}/(s+s)$$

wherein $\sigma$ is a measured strength of semiconductor chips having a scallop of size s, $\sigma_{max}$ is a maximum strength of the semiconductor chips, and s* characterizes the scallop size-scale over which the semiconductor strength varies.

14. The method according to claim 1, wherein the mechanical strength of the semiconductor chips is estimated based upon at least one defect selected from the group consisting of a maximum diameter of the scallops, defects characterizing scallop size distribution, scallop diameter parallel to an edge of the semiconductor chip that the scallop is closest to, and scallop area.

15. The method according to claim 1, further comprising the step of:

testing an electrical functioning of the semiconductor chips; and sorting the semiconductor chips based upon the testing of electrical functioning.

16. The method according to claim 1, further comprising the step of:

directing the semiconductor chips to a plurality of applications with corresponding physical stress levels on the semiconductor chips, such that semiconductor chips having higher mechanical strengths are directed to applications with higher physical stresses and semiconductor chips having lower mechanical strengths are directed to applications with lower physical stresses.

17. A device for sorting semiconductor chips, the device comprising:

a detector for detecting at least one physical defect of the semiconductor chips;

a processor for estimating the mechanical strength of the semiconductor chips by analyzing the at least one physical defect;

a sorter for sorting the semiconductor chips based upon the at least one physical defect;

at least one device for separating the semiconductor chips from other semiconductor chips and/or from portions of a larger substrate on which the semiconductor chips have been formed; and at least one device for engaging, picking up, and transporting the semiconductor chips.

18. The device according to claim 17, wherein the device for engaging, picking up, and transporting the semiconductor chips is a vacuum pencil.

19. A device for sorting semiconductor chips, the device comprising:

a detector for detecting at least one physical defect of the semiconductor chips;

a processor for estimating the mechanical strength of the semiconductor chips by analyzing the at least one physical defect; and a sorter for sorting the semiconductor chips based upon the at least one physical defect, wherein the device sorts the semiconductor chips to determine an acceptable application for the semiconductor chips, wherein the acceptable application includes at least one member selected from the group consisting of a package type that the semiconductor chips are to be incorporated into and a use of the package.

20. A device for sorting semiconductor chips, the device comprising:

a detector for detecting at least one physical defect of the semiconductor chips;

a processor for estimating the mechanical strength of the semiconductor chips by analyzing the at least one physical defect;

a sorter for sorting the semiconductor chips based upon the at least one physical defect; and a plurality of trays that the sorted semiconductor chips are deposited into, the trays corresponding to a plurality of acceptable defect levels, estimated mechanical strengths and a plurality of acceptable applications based upon the defect levels.

21. A device for sorting semiconductor chips, the device comprising:

a detector for detecting at least one physical defect of the semiconductor chips;

a processor for estimating the mechanical strength of the semiconductor chips by analyzing the at least one physical defect; and a sorter for sorting the semiconductor chips based upon the at least one physical defect, wherein the at least one physical defect is at least one scallop in a surface of the semiconductor chips and the processor analyzes the at least one physical defect according to the following relationship:

$$\sigma=\sigma_{max}s^*/(s+s^*)$$

wherein $\sigma$ is a measured strength of semiconductor chips having a scallop of size s, $\sigma_{max}$ is a maximum strength of the semiconductor chips, and s* characterizes the scallop size-scale over which the semiconductor strength varies.

22. A device for sorting semiconductor chips, the device comprising:

a detector for detecting at least one physical defect of the semiconductor chips;

a processor for estimating the mechanical strength of the semiconductor chips by analyzing the at least one physical defect; and a sorter for sorting the semiconductor chips based upon the at least one physical defect, wherein the at least one physical defect is a scallop in a surface of the semiconductor chips and the device estimates the mechanical strength of the semiconductor chips based upon at least one defect selected from the group consisting of a maximum diameter of the scallops, defects characterizing scallop size distribution, scallop diameter parallel to an edge of the semiconductor chip that the scallop is closest to, scallop area, and a scallop dimension relative to at least one measure of dimension of the semiconductor chip including the scallop.

23. The device according to claim 22, further comprising:

an electrical tester for testing electrical function of the semiconductor chips; and a sorter for sorting the semiconductor chips based upon the electrical testing.

24. A device for sorting semiconductor chips, the device comprising:

a detector for detecting at least one physical defect of the semiconductor chips;

a processor for estimating the mechanical strength of the semiconductor chips by analyzing the at least one physical defect; and a sorter for sorting the semiconductor chips based upon the at least one physical defect, wherein after sorting the semiconductor chips the device directs the semiconductor chips to an application with a corresponding physical stress on the semiconductor chips, such that semiconductor chips having higher estimated mechanical strengths are directed to applications with higher physical stresses and semiconductor chips having lower estimated mechanical strengths are directed to applications with lower physical stresses.

25. A method for forming an electronic package including a semiconductor chip and a semiconductor chip carrier, the method comprising the steps of:

creating a plurality of semiconductor chips in a substrate;

separating the individual semiconductor chips from each other and/or from other portions of the substrate;

detecting at least one physical defect of the semiconductor chips;

estimating the mechanical strength of the semiconductor chips by analyzing the at least one physical defect;

sorting the separated semiconductor chips based upon the at least one physical defect and estimated mechanical strength; and mounting the semiconductor chips onto a carrier.

* * * * *